United States Patent [19]

Fercho et al.

[11] 4,304,309

[45] Dec. 8, 1981

[54] SURFACE DRILLING APPARATUS

[75] Inventors: Edward Fercho; Douglas W. L. Bradley, both of Calgary; Dennis Shears, Vancouver, all of Canada

[73] Assignee: Dome Petroleum Limited, Calgary, Canada

[21] Appl. No.: 32,531

[22] Filed: Apr. 23, 1979

[51] Int. Cl.[3] ..... E21B 4/00

[52] U.S. Cl. ..... 175/95; 175/215; 175/69; 175/106

[58] Field of Search ..... 175/60, 69, 95, 100, 175/106, 213, 215, 332, 335, 342, 351, 373; 299/18, 56

[56] References Cited

U.S. PATENT DOCUMENTS

| | | | |
|---|---|---|---|
| 1,512,658 | 10/1924 | Woodruff | 175/351 X |
| 1,547,461 | 7/1925 | Steele | 175/215 X |
| 3,077,358 | 2/1963 | Costa | 175/95 |
| 3,161,243 | 12/1964 | Davis | 175/95 |
| 3,338,322 | 8/1967 | Henderson | 175/60 X |
| 3,379,264 | 4/1968 | Cox | 175/213 X |
| 3,431,989 | 3/1969 | Waterman | 175/213 X |
| 3,596,722 | 8/1971 | Allard | 175/103 |
| 3,770,067 | 11/1973 | Ikeda | 175/95 |
| 3,807,514 | 4/1974 | Murrell | 175/60 X |
| 4,102,415 | 7/1978 | Cunningham | 175/373 |

*Primary Examiner*—James A. Leppink
*Assistant Examiner*—Richard E. Favreau
*Attorney, Agent, or Firm*—Larson, Taylor and Hinds

[57] ABSTRACT

A surface drilling apparatus for drilling large diameter holes in soft to medium-hard earth formations includes a cylindrical casing defined by a stationary upper section and a lower section rotatable relative to the upper section; a plurality of circular rows of cutting discs rotatably mounted on the base of the lower section for cutting material beneath the apparatus; a transfer pipe in the center of the base of the lower section for receiving cut material from the cutting discs and feeding the cut material upwardly through a discharge pipe for carrying the material upwardly to the surface; and an annular, upwardly inclined slot in the discharge pipe at the top of the upper section through which air is fed under pressure into the discharge pipe to induce the cut material upwardly from the transfer pipe and blow the material upwardly.

9 Claims, 7 Drawing Figures

SURFACE DRILLING APPARATUS

FIELD OF THE INVENTION

This invention relates to a soft surface drilling apparatus.

More specifically, the invention relates to an apparatus for drilling large diameter holes, i.e. holes with diameters of 6 feet or more in near surface earth formations including formations of cohesive surface soils, fine and coarse gravel beds, soft to medium hard shales, and the like in both land and underwater environments. The apparatus can be employed in temperate and cold climes, even when the above-mentioned formations are held together by what is generally known as permafrost.

BACKGROUND OF THE INVENTION

The uses of a large diameter drilling apparatus of the type disclosed herein include the drilling of subsea silos for the protection of underwater blowout preventors used when drilling exploratory wells for hydrocarbons in ice infested waters, shipping lanes, fishing areas, etc.; drilling holes for the installation of large diameter construction piles on land and underwater in inland waters and offshore; in offshore mining for minerals; in drilling large diameter vent and production shafts in mining for coal, potash and other minerals; in drilling large diameter vent and production shafts for developing production in heavy oil areas of the world and in the mining of hydrocarbons generally referred to as the tar sands; in recovering mine tailings from tailing ponds, and in harbour benching.

In general, such a drilling apparatus should be such that the earth formations can be drilled and the loose material removed, i.e. the apparatus should include drilling and loose material removing facilities, without requiring a separate removal system.

SUMMARY OF THE INVENTION

The object of the present invention is to provide a relatively simple surface drilling apparatus, which incorporates a loose material removal system.

Accordingly, the present invention relates to a surface drilling apparatus for drilling a large diameter hole comprising a casing, said casing including a normally fixed upper portion and a lower section rotatably mounted on the bottom of said top portion, drive means for rotating said lower section relative to said upper section; cutter means rotatably mounted on the base of said lower portion for cutting material in an earth formation beneath the apparatus and for directing cut material towards the bottom centre of the base of said lower portion; transfer pipe means mounted in said base of said lower portion for receiving such cut material and feeding the cut material into said casing; discharge pipe means mounted in and extending upwardly from said upper portion of said casing in fluid communication with said transfer pipe means for receiving the cut material from said transfer pipe and discharging said material upwardly from the apparatus; and means communicating with said discharge pipe means for drawing cut material upwardly through said transfer pipe means into said discharge pipe means and for discharging the cut material upwardly through the discharge pipe means.

BRIEF DESCRIPTION OF THE DRAWINGS

The invention will now be described in greater detail with reference to the accompanying drawings, which illustrate a preferred embodiment of the invention, and wherein.

DESCRIPTION OF THE PREFERRED EMBODIMENTS

Figure 1:
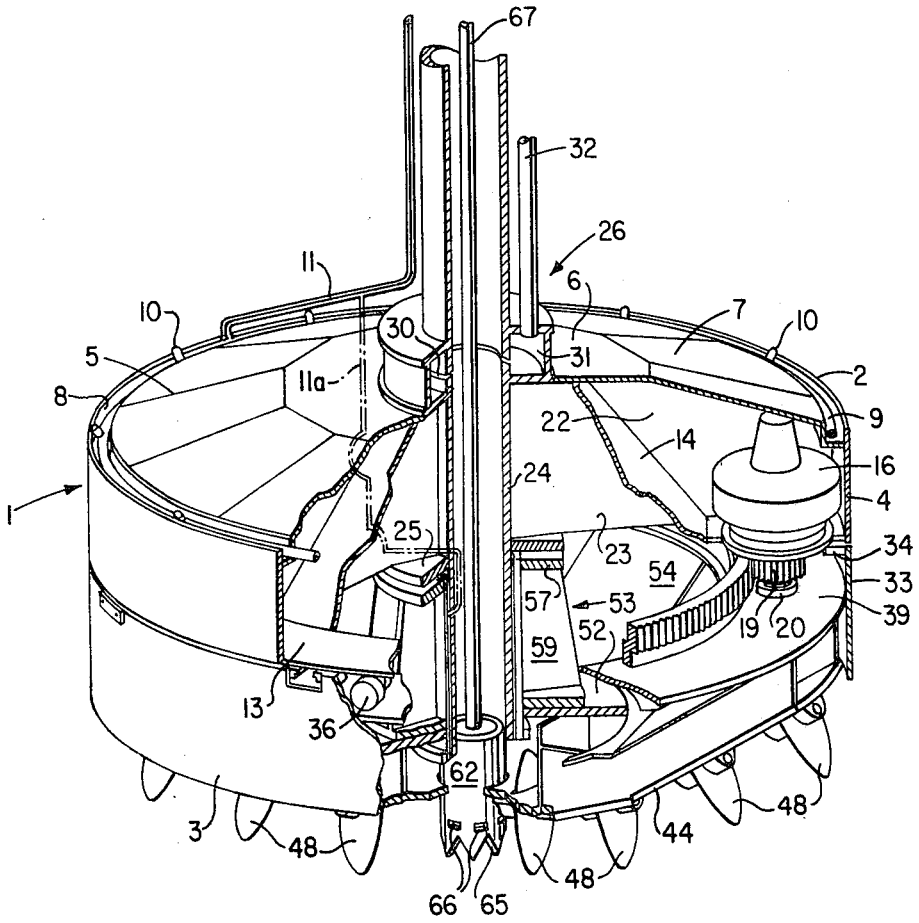
FIG. 1 is a schematic, partly sectioned, perspective view from above of a preferred embodiment of an apparatus in accordance with the present invention with parts omitted.
Figure 2:
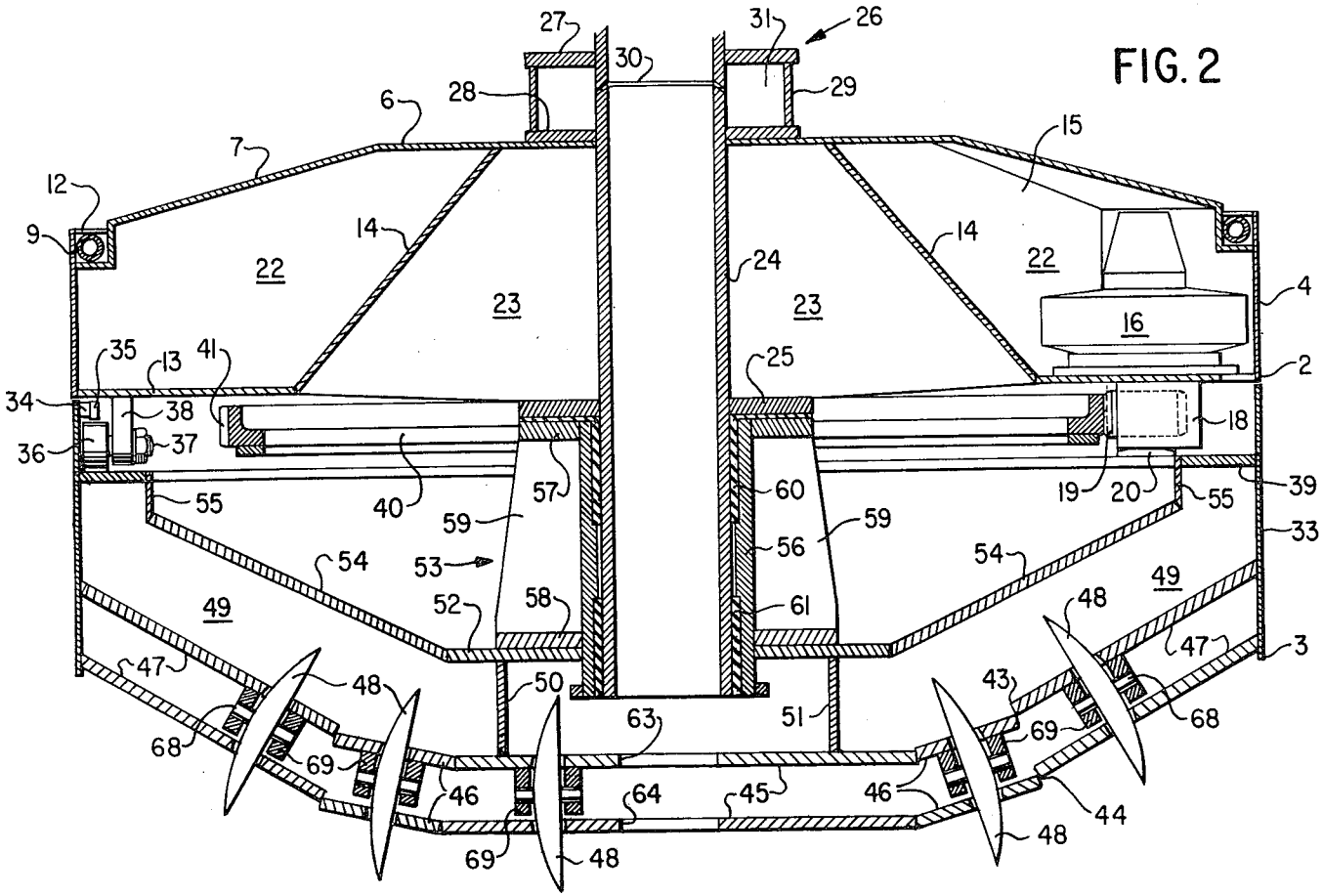
FIG. 2 is a cross-sectional view of the apparatus of FIG. 1.
Figure 3:
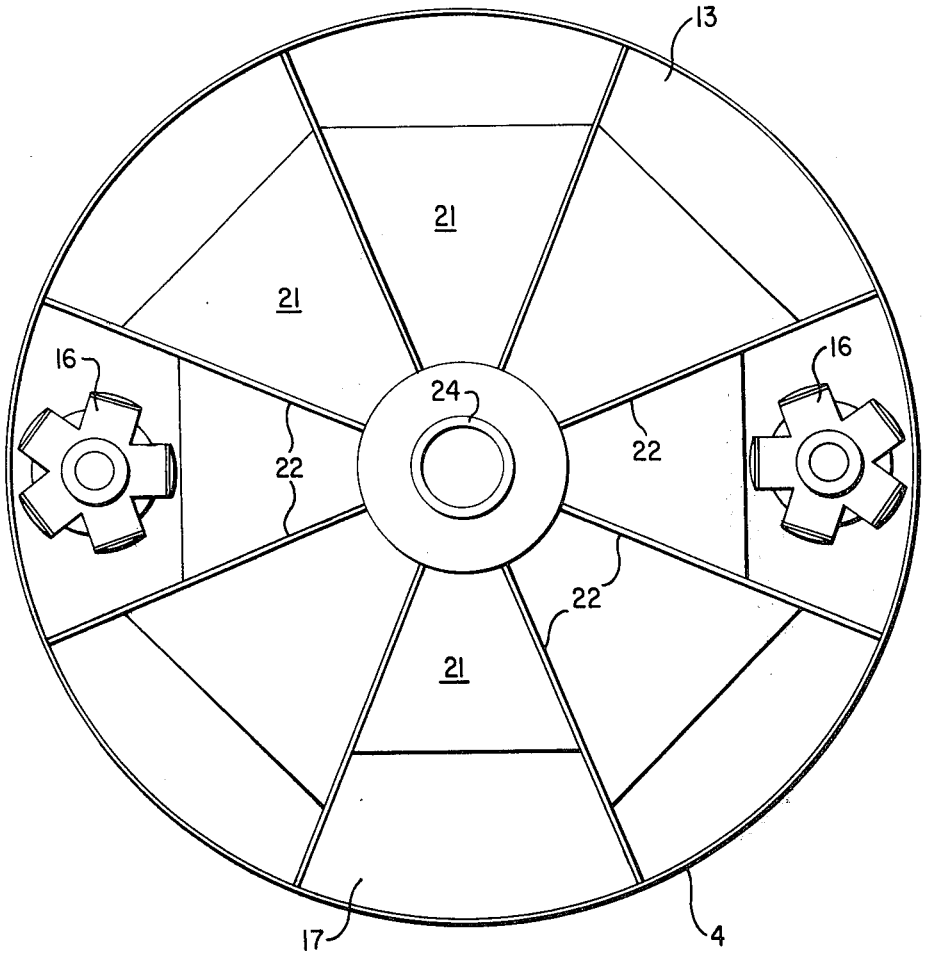
FIG. 3 is a plan view of the upper portion of the apparatus of FIGS. 1 and 2, with the top removed.
Figure 5:
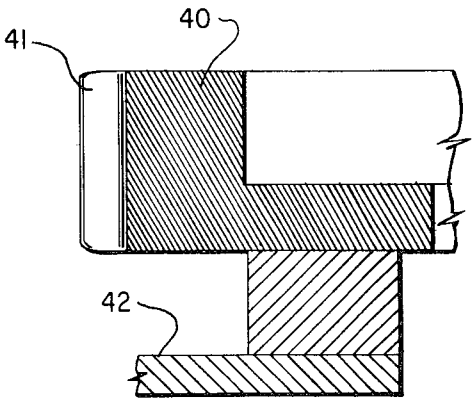
FIG. 5 is a cross-sectional view of the roller track taken generally along line 5—5 of FIG. 4.

With reference to FIGS. 1 to 3, the preferred embodiment of the drilling apparatus of the present invention includes a cylindrical casing generally indicated at 1 defined by an upper portion 2 and a lower portion 3. The upper portion 2 includes a cylindrical side wall 4 and a top wall 5. The top wall 5 is defined by a planar, horizontal central section 6 and inclined sides 7 integral with the central portion 6 and extending downwardly and outwardly to the top edge of the side walls 4. An annular trough 8 is provided at the junction between the side and top walls 4 and 5, respectively for receiving an annular pipe 9. The pipe 9 is provided with a plurality of outwardly and upwardly extending nozzles 10. Water under pressure is fed into the pipe 9 via a pipe 11 for discharge from the nozzles 10. The pipe 9 is covered by a cover 12 (FIG. 2) through which the nozzles 10 project.

The outer edge of an annular base 13 is connected to the bottom end of the side wall 4, and the inner edge of the base 13 is connected to the central portion 6 of the top wall 5 by a generally frusto-conical inner wall 14. The side wall 4, top wall 5 and inner wall 14 define a chamber 15 for housing hydraulic, electrical or air driven motors 16. While only two motors are shown, additional motors can be added for example at location 17.

A cowl 18 (FIG. 2) extends downwardly from the base 13 of the upper section 2 around the major part of a pinion 19 on the bottom of each motor 16 for supporting a bearing 20 on the bottom end of the pinion 19.

As illustrated in FIG. 3, the inner edge of the base 13 is irregular, i.e. the plate is wider at the motor locations. Thus, the inner wall 14 is formed by a plurality of tapering plates 21. Vertical reinforcing ribs in the form of panels 22 extend between the interior surface of the top wall 5 and the inner wall 14 and base 13. Vertical reinforcing ribs 23 also extend between the bottom surface of the inner wall 14 and a discharge pipe 24 in the center of the casing. The internal cavities or chambers defined by panels 22 and walls 14 may be utilized to contain ballast, when the apparatus is operated under water.

The discharge pipe 24 extends through the central section 6 of the top wall 5, and in use is connected to other pipe sections (not shown) which are added to lengthen the discharge pipe as drilling proceeds. The inner bottom edges of the ribs 23 rest on an annular ledge 25 extending outwardly from the discharge pipe 24 at the bottom of the upper portion 2 of the casing 1.

An annular casing generally indicated at 26 defined by top and bottom walls 27 and 28, respectively and side wall 29, is provided on the top of the central section 6 of the top wall 5 surrounding the discharge pipe 24. An annular, upwardly inclined slot 30 in the discharge pipe 24 establishes fluid communication between the chamber 31 in the casing 26 and the interior of the discharge pipe 24. Air under pressure is introduced into the chamber 31 and consequently into the discharge pipe 24 via a pipe 32 (FIG. 1), which extends through the top wall 27 of the casing 26.

Figure 4:
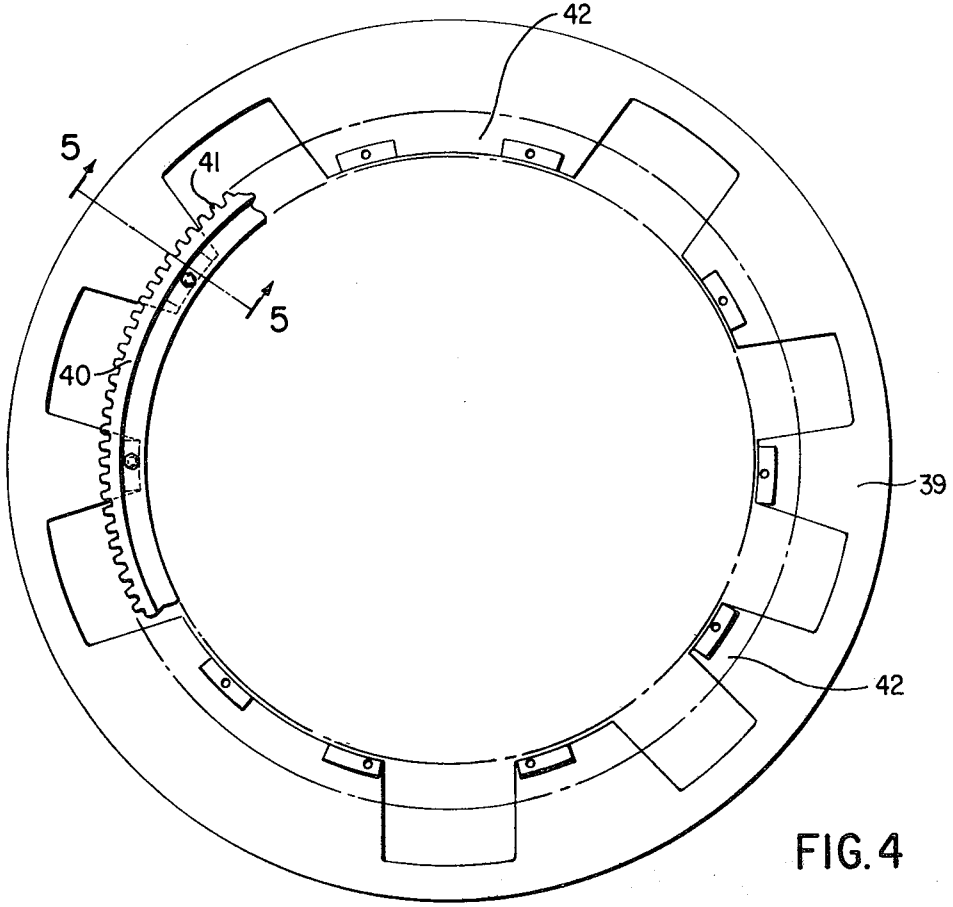
FIG. 4 is a plan view of a roller track used in the apparatus of FIGS. 1 to 3.

The lower portion 3 of the casing 1 includes a cylindrical side wall 33 with an annular ledge 34 extending inwardly from the top inner edge thereof. Inner edge 35 of the ledge 34 defines the top of an annular track for rollers 36. A plurality of such rollers 36 are rotatably mounted on stub axles 37, which are mounted in the bottom end of arms 38 extending downwardly from the base 13 of the upper portion 2 of the casing 1. A second annular ledge 39 beneath the ledge 34 supports the rollers 36 during drilling (FIG. 2). An annular rack 40 with external teeth 41 for engaging the pinion 19 is mounted on inwardly extending projections 42 of the ledge 39 (FIG. 4).

Parallel, spaced apart bottom walls 43 and 44 are connected to the bottom end of the side wall 33. Each of the bottom walls 43 and 44 is formed by a planar central section 45, an upwardly inclined intermediate section 46, and a more steeply inclined outer section 47 for rotatably supporting a plurality of cutter plates 48. Partitions 49, 50 and 51 extending upwardly from the uppermost bottom walls 43 support a circular plate 52, which forms part of a sleeve structure generally indicated at 53.

The partitions 49 also support inclined panels 54, and vertical inner side walls 55. The plate 52, and panels 54 and 55 isolate the top interior of the lower section 3 from the bottom blade area.

The sleeve structure 53 is mounted on the plate 52 and includes a central sleeve 56 extending through the plate 52 upwardly to immediately beneath the ledge 25, and radially extending top and base plates 57 and 58, respectively. Vertical reinforcing ribs 59 extend between the top and base plates 57 and 58. The sleeve structure 53 is spaced from the discharge pipe 24 and the ledge 25 by bushings 60 and 61 so that the sleeve structure 53 and the remainder of the lower section 3 of the casing 1 can be rotated while the upper section 2 remains stationary. As shown schematically, in phantom, in FIG. 1, a secondary pipe 11*a* is provided, which branches from pipe 11 and passes through the apparatus to terminate in the area between sleeve structure 53 and discharge pipe 24. This secondary pipe 11*a* permits water to be discharged within the bearing area, thereby partially pressurizing same. Bushings 60 and 61 are not in this embodiment, fluid tight, therefore there is a flow of water which effectively excludes ingress of cut material to the bearing area that would otherwise accumulate therein and be detrimental to the rotation of casing 1.

A transfer pipe 62 is mounted in the bottom end of the discharge pipe 24 and extends downwardly through aligned apertures 63 and 64 in the bottom walls 43 and 44, respectively. The bottom end of the transfer pipe 62 extends downwardly beyond the bottom wall 44 for receiving material (commonly referred to as spoil) cut by the blades 48. For such purpose, the bottom end of the pipe 62 is provided with teeth 65 which act as a seive. A row of slots 66 above the teeth 65 admit cut material to the transfer pipe 62. A water inlet pipe 67 extends downwardly centrally of the discharge pipe 24 to the top end of the transfer pipe 62 for introducing water to the transfer pipe from above and maintaining a slurry of the cut material therein.

As shown in FIG. 2, the blades 48 are rotatably mounted on journals 68 in pillow block bearings 69 on each of the sections 45, 46 and 47 of the bottom walls 43 and 44 of the lower section 3 of the casing 1. In the preferred embodiment of the invention bearings 69 are mounted such that they depend from the uppermost bottom wall 43. It is however to be understood that they may also be on the top of the lowermost bottom wall 44. A plurality of radially extending, staggered rows of blades 48 are provided on the bottom end of the lower section 3 of the casing 1 for making a plurality of circular cuts in the material beneath the apparatus. As illustrated in FIG. 1, the outermost row of blades 48 extends outwardly sufficiently to cut a circular path of the same diameter as the casing 1. The angle of the blades 48 with respect to the circular path of travel is adjustable so that the angle of the blades 48 can be varied to ensure that they push cut material to the center of the apparatus, i.e. to the bottom end of the transfer pipe. It is also a feature of the present invention that the shape of the blades 48 and their relative positioning ensures the self centering of the apparatus when in operation.

While it is not shown, the means for adjusting the angle of each of the blades 48 is simple. It is merely to provide a plurality of mounting positions for the pillow block bearings in the bottom walls 43 and 44.

Figure 6:
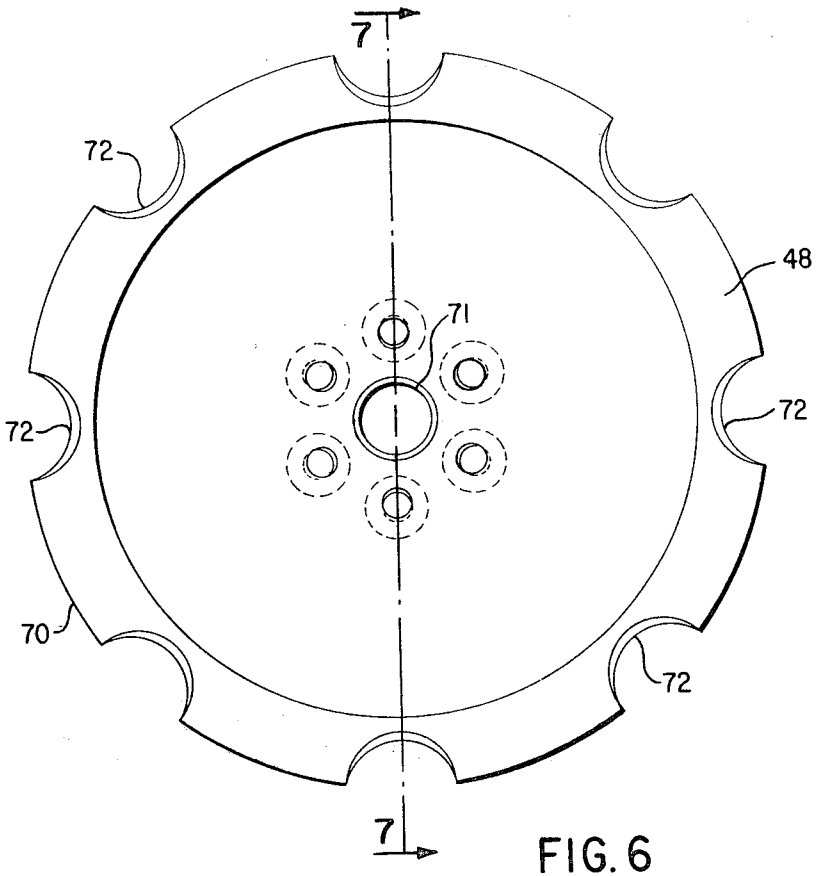
FIG. 6 is a bottom view of a cutter blade used in the apparatus of FIGS. 1 to 5.
Figure 7:
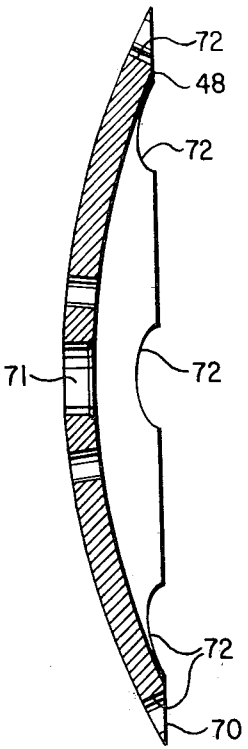
FIG. 7 is a cross-sectional view of the cutter blade taken generally along line 7—7 of FIG. 6.

Referring now to FIGS. 6 and 7, each of the cutter blades 48 is in the form of a concave-convex disc with a sharp periphery 70, the concave side of the blade facing the centre of the apparatus. The journal 68 extends through a central aperture 71 in the blade 48. A plurality of concave grooves 72 are spaced equidistant apart in the periphery of the blade 48 for improving the cutting action of the blade and to ensure rotation.

It is to be further understood that scraping devices, not shown, may be included in association with each of the blades 48 to ensure that their rotation is uninhibited by adherence of cut material.

In operation, with the apparatus in position, the motors 16 are started to rotate the lower section 3 of the casing 1 around the londitudinal axis of the discharge pipe 24 to initiate cutting by the cutting discs 48. At the same time, water is fed into the transfer pipe 62 via the water inlet pipe 67 to form a slurry of cut material entering the bottom of the transfer pipe 62 between the teeth 65 and through the slots 66. If the material is not being efficiently fed into the transfer pipe 62 by the blades 48, the angle of the blades 48 is changed. Water is also fed into the annular pipe 9 and discharged radially outwardly against the walls of the hole being drilled to wash down the walls, and to act as a fluidizing means for ease of withdrawal. The slurry formed in the transfer pipe 62 is induced into the discharge pipe 24 by air fed into the chamber 31 under pressure of up to 100 psi and through the inclined, annular slot 30 into the discharge pipe. Of course, the air pressure can be varied depending on the amount of suction required to induce and discharge the material in the transfer pipe 62.

While an air lift principle has been described as a preferred method of material extraction, it will be appreciated that other methods may be equally applicable, for example the use of conventional suction pumps, or mechanical material lifting devices such as screw conveyors or augers.

It will further be appreciated that the water inlet pipe 67 is not required in drilling holes under water or in holes containing water.

Further modifications and alternative embodiments of the invention will be apparent to those skilled in the art in view of the foregoing description. Accordingly this description is to be construed as illustrative only and is for the purpose of teaching those skilled in the art the manner of carrying out the invention. It is further understood that the form of the invention herewith shown and described is to be taken as the presently preferred embodiment. Various changes may be made in the shape, size and general arrangement of components. For example, equivalent elements may be substituted for those illustrated and described herein, party may be used independently of the use of other features, all as will be apparent to one skilled in the art after having the benefits of the description of the invention.

What is claimed is:

1. A surface drilling apparatus for drilling a large diameter hole comprising a casing which includes a normally fixed upper portion and a lower portion rotatably mounted on the bottom of said upper portion, said lower portion including a bottom wall that substantially covers the bottom of said casing and which has a central opening therein;

drive means for rotating said lower portion relative to said upper portion;

cutter means mounted on said lower portion and projecting from said bottom wall for cutting material in an earth formation beneath the apparatus and for directing cut material towards the bottom centre of said bottom wall of said lower portion, said cutter means including a plurality of cutting discs each rotatably mounted on said lower portion so as to undergo a circular path of travel during drilling, the orientation of said discs being adjusted with respect to said circular path of travel so as to push cut material toward said bottom wall central opening;

transfer pipe means mounted in said bottom wall central opening of said lower portion for receiving such cut material and feeding the cut material into said casing;

discharge pipe means mounted in and extending upwardly from said upper portion of said casing in fluid communication with said transfer pipe means for receiving the cut material from said transfer pipe means and discharging said material upwardly from the apparatus; and material extraction means communicating with said discharge pipe means for drawing cut material upwardly through said transfer pipe means into said discharge pipe means and for discharging the cut material upwardly through the discharge pipe means.

2. A drilling apparatus according to claim 1, wherein said material extraction means includes a second casing defining a chamber surrounding said discharge pipe means at the top of said upper section; an inlet duct for introducing air under pressure into said chamber; and upwardly inclined slot means in said discharge pipe means permitting passage of said air under pressure into said discharge pipe means, whereby suction is created in said discharge and transfer pipe means to force cut material upwardly in the discharge pipe means.

3. A drilling apparatus according to claim 1, wherein said transfer pipe means includes teeth at the bottom end thereof and circumferentially extending slots above said teeth, the teeth and slots acting as seives for the cut material.

4. A drilling apparatus according to claim 1, including inlet pipe means extending downwardly in said discharge pipe means to the top end of said transfer pipe means for introducing water into said transfer pipe means to form a slurry of the cut material.

5. A drilling apparatus according to claim 1, wherein said drive means includes a plurality of motors mounted in said upper section of the casing; a pinion driven by each said motor; and an annular rack mounted on said lower section meshing with the pinions.

6. A drilling apparatus according to claim 1, including an annular pipe extending around the top end of said upper section; nozzles in said annular pipe directed outwardly towards the periphery of said casing; and means for supplying water to said annular pipe for discharge through said nozzles to wet the hole being drilled by the drilling apparatus.

7. A drilling apparatus according to claim 1 wherein said bottom wall of said casing bottom portion has an overall convex shape and has a plurality of slots therethrough, and wherein each of said cutting discs extends through a corresponding one of said slots.

8. A drilling apparatus according to claim 1 wherein each of said discs are concave-convex with a sharp periphery, said discs being mounted so as to have the concave side thereof facing said central opening of said bottom wall, and wherein each of said discs has a plurality of concave grooves spaced equidistant apart in the periphery thereof.

9. A drilling apparatus according to claim 1 wherein said transfer pipe means extends below the casing but terminates proximate to the lowest point of said discs.

* * * * *